US006292981B1

(12) United States Patent
Ford et al.

(10) Patent No.: US 6,292,981 B1
(45) Date of Patent: Sep. 25, 2001

(54) CRESCENT HINGE

(75) Inventors: James J. Ford; David M. Fusina, both of West Chester; Edward A. Kurek, III, North Wales; Charles R. Scally, Warmister, all of PA (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/549,683

(22) Filed: Apr. 14, 2000

Related U.S. Application Data

(60) Provisional application No. 60/129,220, filed on Apr. 14, 1999.

(51) Int. Cl.[7] ..... E05D 11/06; E05D 15/06

(52) U.S. Cl. ..... 16/357; 16/361

(58) Field of Search ..... 16/357, 361, 355, 16/358, 359, 273, 334

(56) References Cited

U.S. PATENT DOCUMENTS

| | | |
|---|---|---|
| 2,056,805 | 10/1936 | Reichard . |
| 2,770,834 | 11/1956 | Jannace . |
| 5,107,401 | 4/1992 | Youn . |
| 5,169,221 | 12/1992 | Wheeler . |
| 5,735,021 | 4/1998 | Briggs . |
| 5,946,774 | 9/1999 | Ramsey et al. . |

OTHER PUBLICATIONS

Unknown handbook, by Lamp, unknown date, and unknown catalogue page.

*Primary Examiner*—Chuck Y. Mah
(74) *Attorney, Agent, or Firm*—Paul & Paul

(57) ABSTRACT

This invention relates to hinges in general. More particularly, the invention is concerned with hinges wherein it is desired to have no parts of the hinge visible on the outside of a door or enclosure, where, typically in prior art hinges, a hinge pin is located about which the door rotates about the enclosure frame. The hinge of the present invention is visible from only one side of a door and has a first crescent member having a mounting means for mounting to the door and an arcuate cutout, the arcuate cutout describing a radius about a point that is an actual hinge point of the door relative to the frame, a second crescent member having a mounting means for mounting to a frame, and a pair of protruding cylindrical members adapted to be received within the arcuate cut out, the cylindrical members adapted to secure the first crescent member to the second crescent member. The first crescent member is movable about the actual hinge point with respect to said second crescent member.

12 Claims, 10 Drawing Sheets

FIG. 4
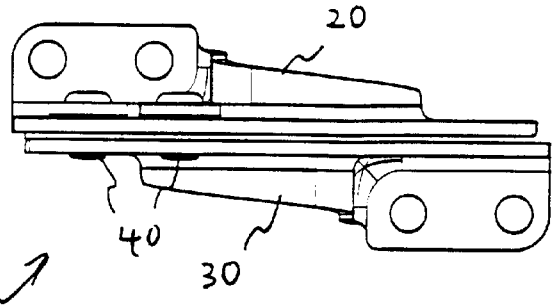
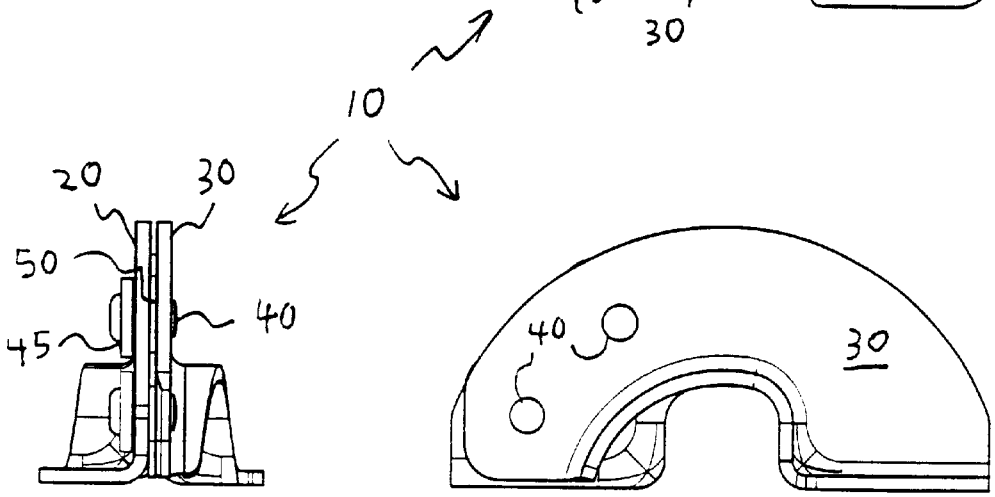
FIG. 5
FIG. 6
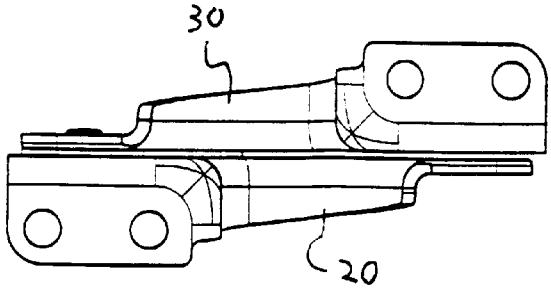
FIG. 7

FIG. 8
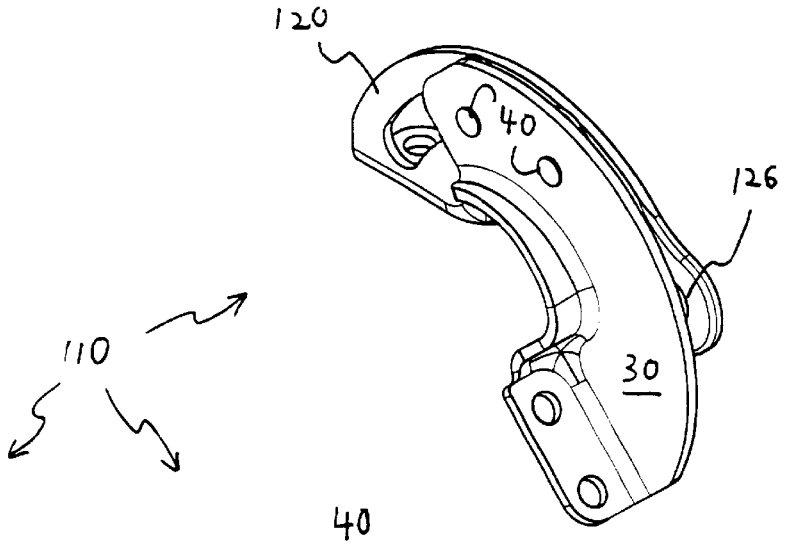
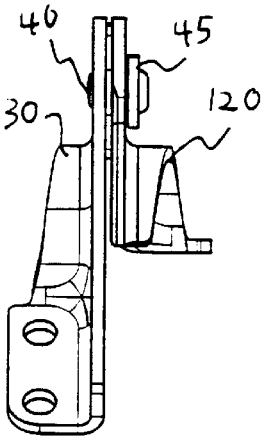
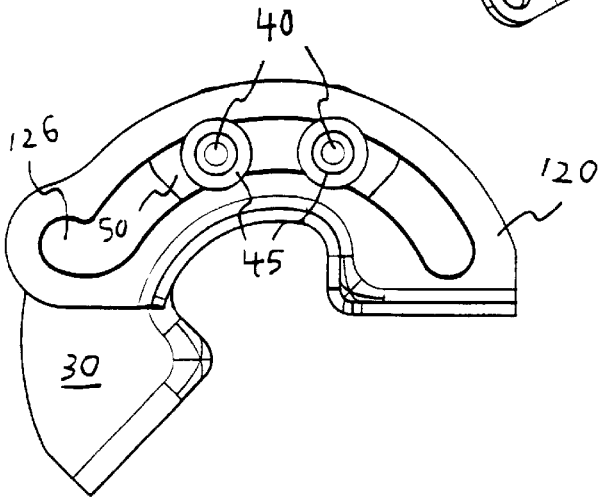
FIG. 9
FIG. 10

FIG. 11
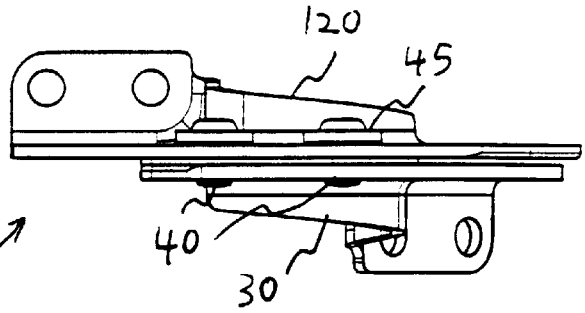
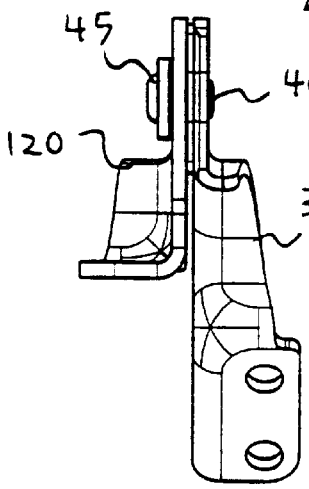
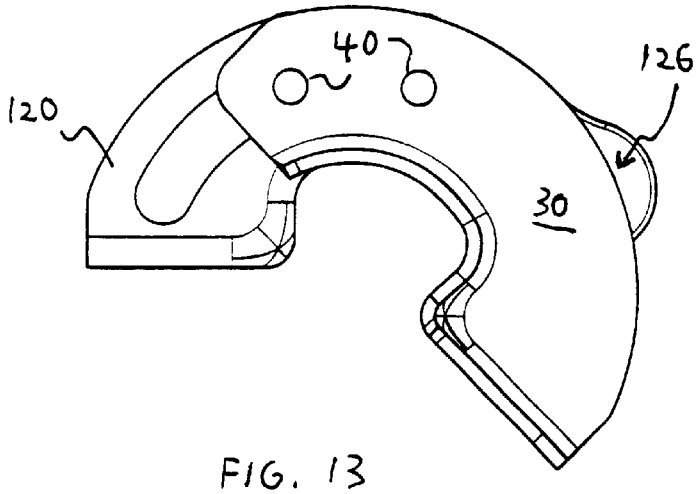
FIG. 13
FIG. 12
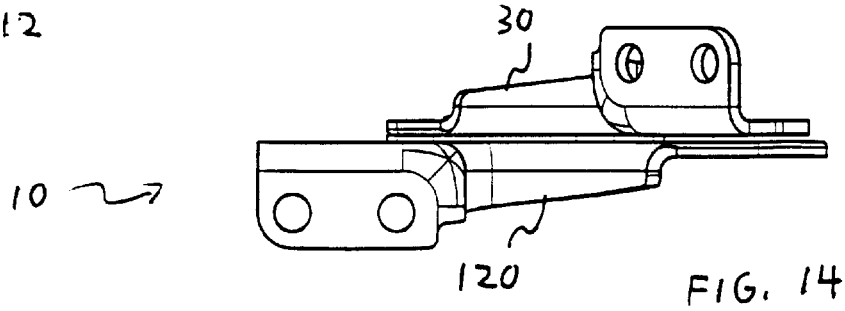
FIG. 14

FIG. 15
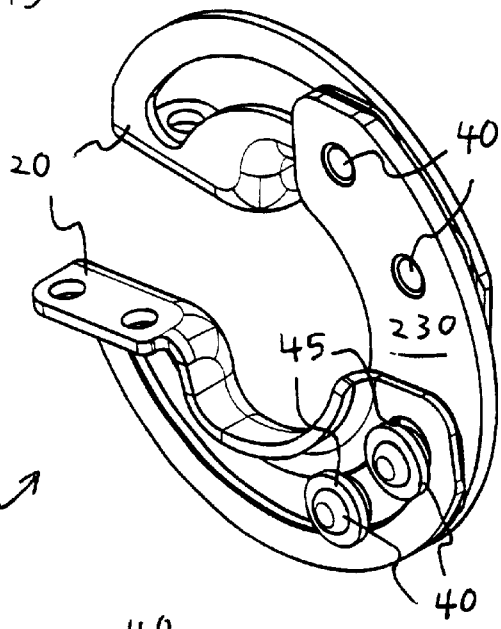
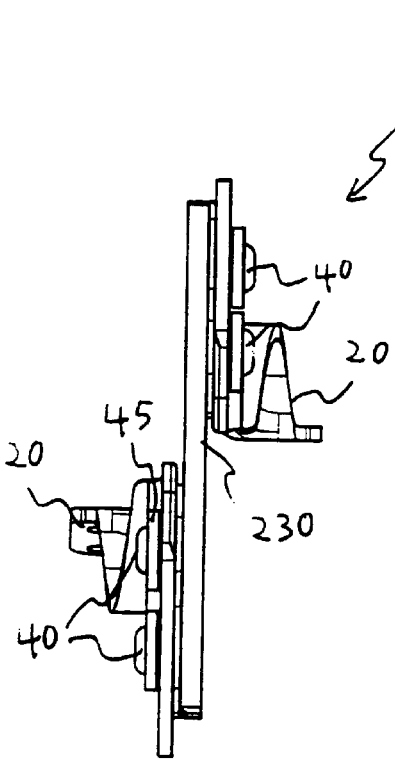
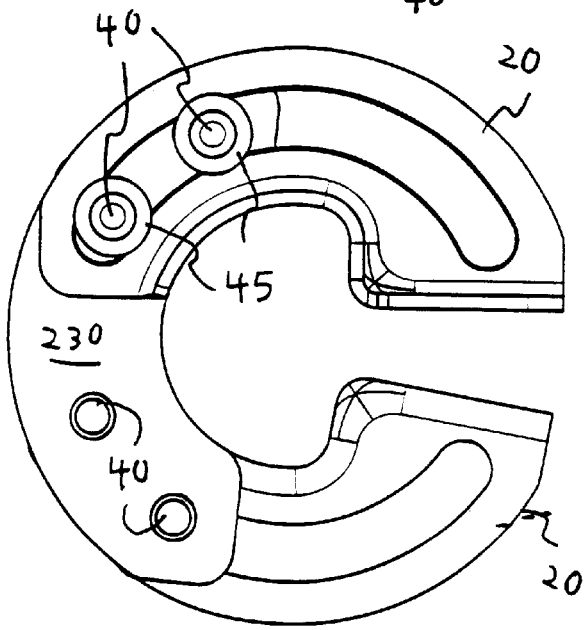
FIG. 16
FIG. 17

CRESCENT HINGE

CROSS-REFERENCE TO RELATED APPLICATION

This application claims the benefit of U.S. Provisional Patent Application Ser. No. 60/129,220, filed Apr. 14, 1999.

BACKGROUND OF THE INVENTION

1. Field of the Invention

This invention pertains to the art of hinges, and more particularly to an improvement in hinges wherein the hinge is concealed on the inside of an enclosure.

2. Description of the Related Art

It is well known to pivotally join a pair of members, such as panels, using a hinge comprising two leaves joined by a pivot pin. The uniqueness of the present invention results from replacing the pivot pin with a crescent-shaped channel in a first leaf, and a pair of studs attached to the first leaf slidably secured within the crescent-shaped channel. The resulting virtual pivot point is not located on the hinge itself.

The invention is particularly applicable to hinges for enclosures or cabinet doors wherein it is desirable to have a clean, hardware-free appearance on the outside of the enclosure or doors, with the hinge components located entirely on the inside of the door.

SUMMARY OF THE INVENTION

This invention relates to hinges in general. More particularly, the invention is concerned with hinges wherein it is desired to have no parts of the hinge visible on the outside of a door or enclosure, where, typically in prior art hinges, a hinge pin is located about which the door rotates about the enclosure frame. The hinge of the present invention is visible from only one side of a door and has a first crescent member having a mounting means for mounting to the door and an arcuate cutout, the arcuate cutout describing a radius about a point that is an actual hinge point of the door relative to the frame, a second crescent member having a mounting means for mounting to a frame, and a pair of protruding cylindrical members adapted to be received within the arcuate cut out, the cylindrical members adapted to secure the first crescent member to the second crescent member. The first crescent member is movable about the actual hinge point with respect to said second crescent member.

It is therefore an object of the present invention to provide a hinge having an invisible point of rotation.

It is a further object of the present invention to provide a hinge for mounting a door to a frame, that is invisible on one side of the door and frame.

It is another object of the present invention to provide a hinge for mounting a door to a frame, that is invisible on one side of the door and frame, that may be held in an open position by the hinge.

It is a still further object of the present invention to provide a hinge for mounting a door to a frame, that is invisible on one side of the door and frame, that opens and closes smoothly with relatively little friction.

It is another object of the present invention to provide a hinge for mounting a door to a frame, that is invisible on one side of the door and frame, that may be opened at least 180 degrees.

Other objects and advantages of the present invention will become apparent from the following description taken in conjunction with the accompanying drawings.

BRIEF DESCRIPTION OF THE DRAWINGS

FIG. 4 is a top view of a first embodiment of a crescent hinge according to the present invention, showing the hinge in the closed position.

FIG. 5 is an end view of a first embodiment of a crescent hinge according to the present invention, showing the hinge in the closed position.

FIG. 6 is a side view of a first embodiment of a crescent hinge according to the present invention, showing the hinge in the closed position.

FIG. 7 is a bottom view of a first embodiment of a crescent hinge according to the present invention, showing the hinge in the closed position.

FIG. 8 is a perspective view of a second embodiment of a crescent hinge according to the resent invention, showing the hinge in the open position.

FIG. 9 is an end view of a second embodiment of a crescent hinge according to the present invention, showing the hinge in the open position.

FIG. 10 is a side view of a second embodiment of a crescent hinge according to the present invention, showing the hinge in the open position.

FIG. 11 is a top view of a second embodiment of a crescent hinge according to the present invention, showing the hinge in the open position.

FIG. 12 is an end view of a second embodiment of a crescent hinge according to the present invention, showing the hinge in the open position.

FIG. 13 is a side view of a second embodiment of a crescent hinge according to the present invention, showing the hinge in the open position.

FIG. 14 is a bottom view of a second embodiment of a crescent hinge according to the present invention, showing the hinge in the open position.

FIG. 15 is a perspective view of a third embodiment of a crescent hinge according to the present invention, showing the hinge in the open position.

FIG. 16 is an end view of a third embodiment of a crescent hinge according to the present invention, showing the hinge in the open position.

FIG. 17 is a side view of a third embodiment of a crescent hinge according to the present invention, showing the hinge in the open position.

DETAILED DESCRIPTION OF THE PREFERRED EMBODIMENT

Figures 1, 2, 3:
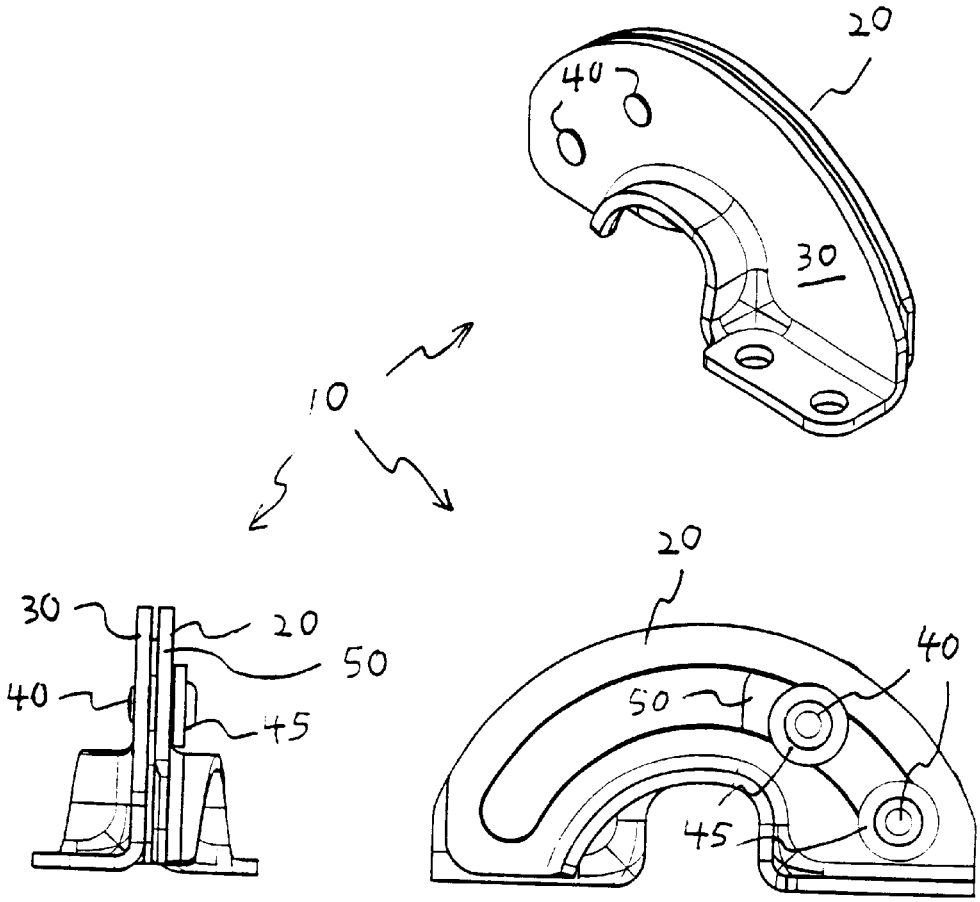
FIG. 1 a perspective view of a first embodiment of a crescent hinge according to the present invention, showing the hinge in the closed position.
FIG. 2 is an end view of a first embodiment of a crescent hinge according to the present invention, showing the hinge in the closed position.
FIG. 3 is a side view of a first embodiment of a crescent hinge according to the present invention, showing the hinge in the closed position.
Figure 18:
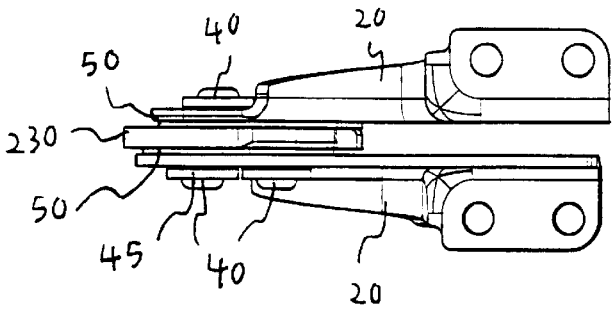
FIG. 18 is a top view of a third embodiment of a crescent hinge according to the present invention, showing the hinge in the open position.
Figure 21:
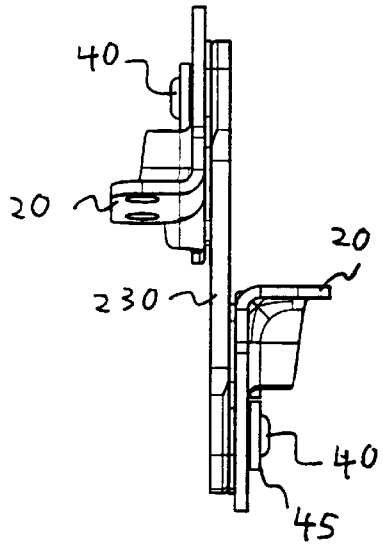
FIG. 21 is an end view of a third embodiment of a crescent hinge according to the present invention, showing the hinge in the open position.
Figure 19:
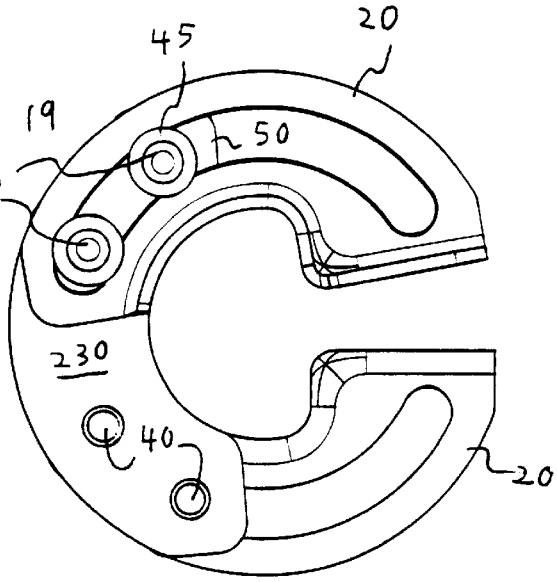
FIG. 19 is a side view of a third embodiment of a crescent hinge according to the present invention, showing the hinge in the open position.
Figure 20:
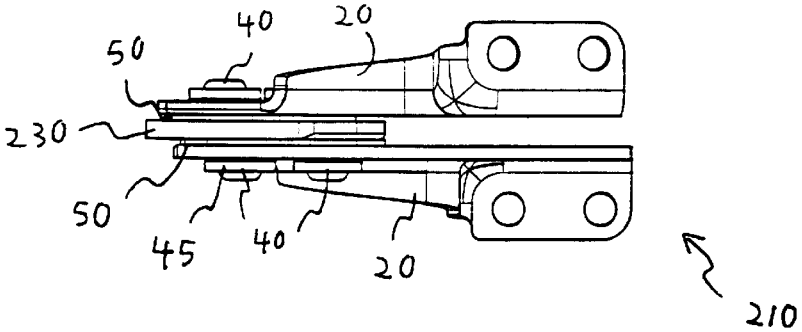
FIG. 20 is a bottom view of a third embodiment of a crescent hinge according to the present invention, showing the hinge in the open position.

Referring now in detail to the drawings, wherein like reference numerals indicate like elements throughout the several views, there is shown in FIGS. 1–14 a crescent hinge 10 in accordance with one preferred embodiment of the present invention. The crescent hinge 10 is typically mounted to a frame and a door (not shown). A first crescent member 20 is mounted to the door, while a second crescent member 30 is mounted to the frame, although this may be reversed.

Figure 22:
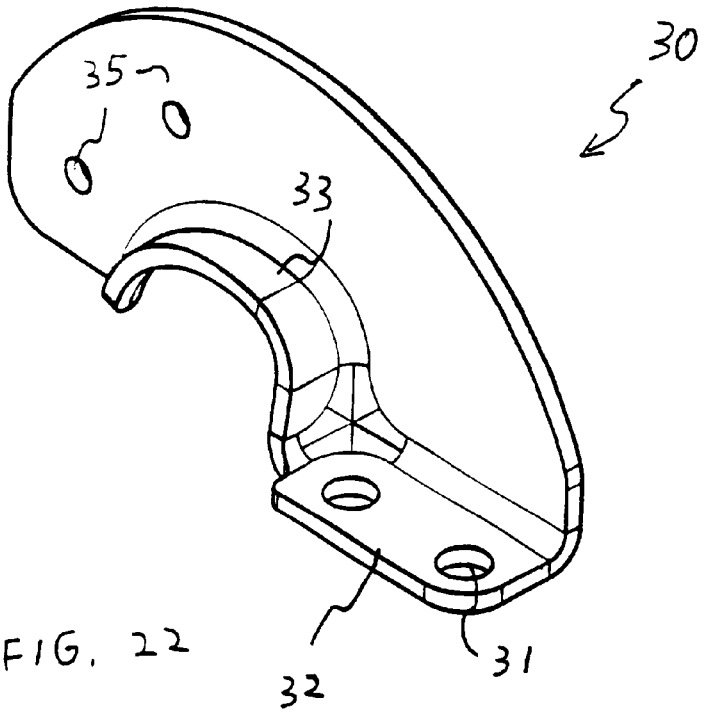
FIG. 22 is a perspective view of a second crescent member for a crescent hinge according to the present invention.
Figure 24:
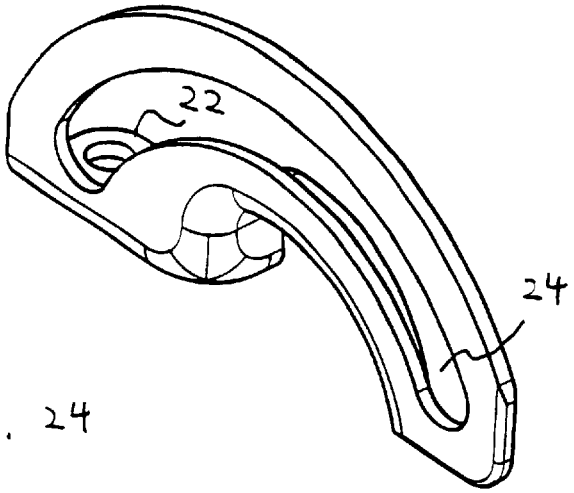
FIG. 24 is perspective view of a first crescent member for a crescent hinge according to the present invention.
Figure 25:
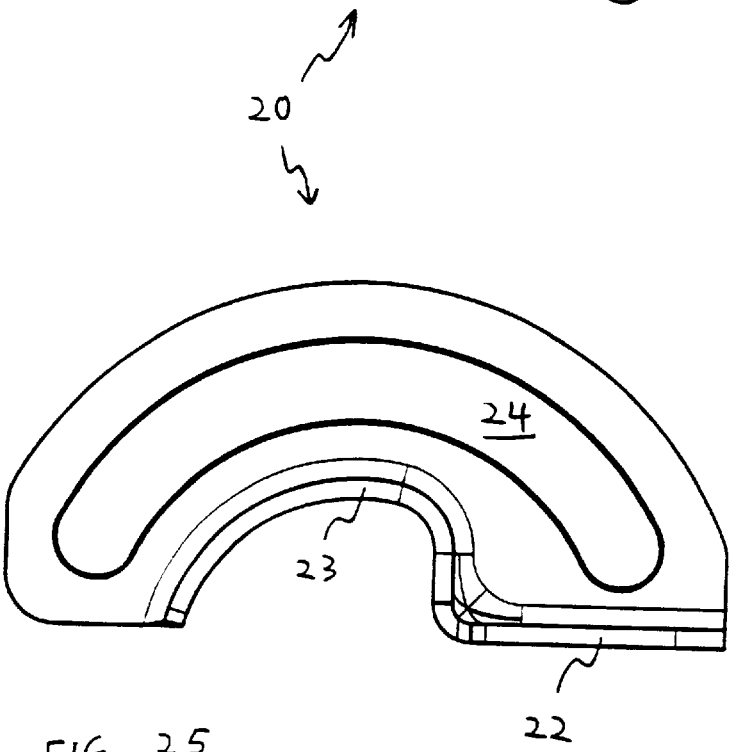
FIG. 25 is a side view of a first crescent member for a crescent hinge according to the present invention.
Figure 26:
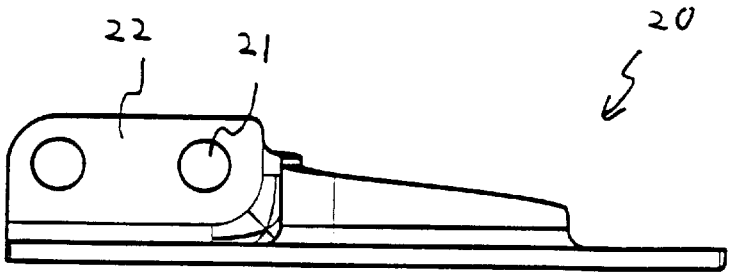
FIG. 26 is a top view of a first crescent member for a crescent hinge according to the present invention.
Figure 27:
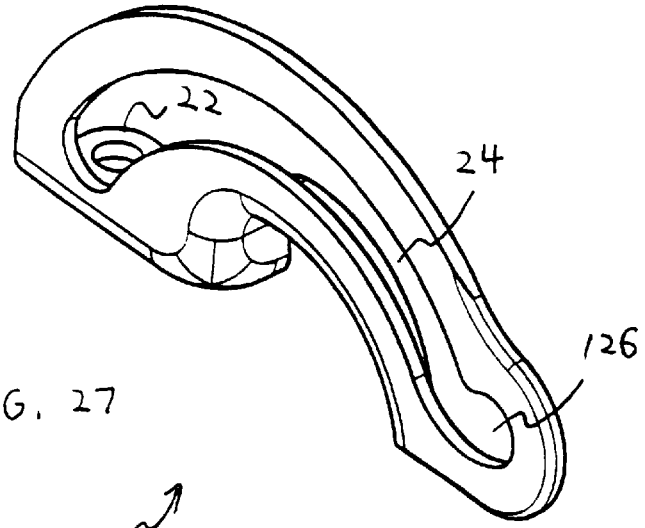
FIG. 27 is a perspective view of a first crescent member for a crescent hinge according to the present invention, showing a dog leg projection in the cutout.
Figure 28:
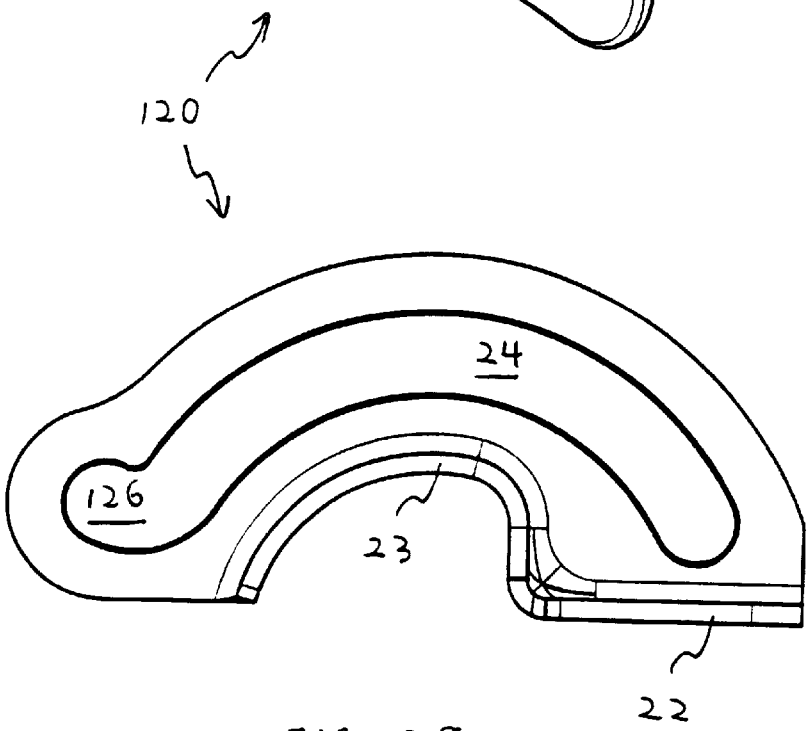
FIG. 28 is a side view of a first crescent member for a crescent hinge according to the present invention, showing a dog leg projection in the cutout.
Figure 29:
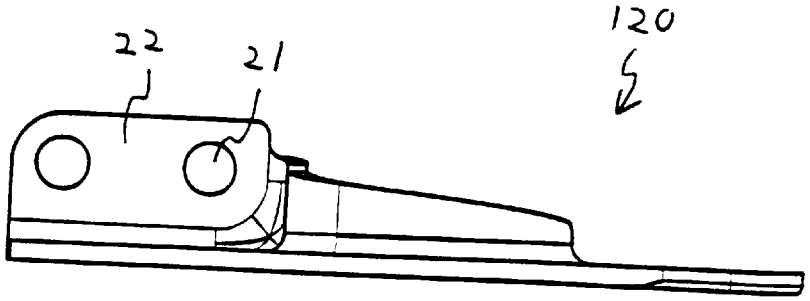
FIG. 29 is a top view of a first crescent member for a crescent hinge according to the present invention, showing a dog leg projection in the cutout.
Figure 30:
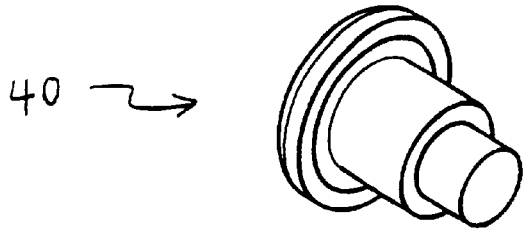
FIG. 30 is a perspective view of a rivet for a crescent hinge according to the present invention.

In this first embodiment, the crescent hinge 10 comprises the first crescent member 20 (see FIGS. 24–26)., the second crescent member 30 (see FIG. 22) and a pair of rivets 40 (see FIG. 30). Each of the first crescent member 20 and second crescent member 30 has a mounting flange 22,32 respectively that are mounted to the frame. For example, these mounting flanges 22,32 may contain through holes 21,31 for accepting threaded studs protruding from the door or frame, or may use any mounting means as known in the art. The mounting flanges 22,32 may also extend around the interior curved surfaces 23,33 of the first crescent member 20 and second crescent member 30, thereby strengthening the first crescent member 20 and second crescent member 30.

A unique aspect of the present invention is the removal of the pivot pin as was previously used in hinges and its replacement with of a "virtual pivot point" of the present invention. Here, the pivot pin is replaced by a guide, preferably an arcuate cutout 24, in the first and crescent member 20 and a pair of protruding studs or rivets 40 located on the second crescent member 30, preferably within holes 35. Crescent member 20 attached to door is free to move within the limits of arcuate cutout 24 limited to a certain movement by rivets 40.. Thus, door must generally travel only along the arc of arcuate cutout 24 and door may not independently rotate due to there not being a single point of rotation. Of course rivets 40 may be replaced by a single elongate protruding member that achieves the same result.

Thus, as can be seen in FIGS. 8–14, the door may be opened the full length of arcuate cutout 24. The door still pivots about a single pivot point; however, that pivot point is not a point on the hinge itself, but is a point that is at the center of the radius of the arcuate cutout 24.

Several optional features may also be incorporated into the present design. First, as can be seen in the second embodiment 110 of FIGS. 8–14, the second embodiment of the first crescent member 120 may have a "dog leg" projection 126 in the arcuate cutout that provides a position to allow a lid to be held in an open position. This embodiment requires that the virtual pivot point be defined by a horizontal axis, and is particularly useful when it is desired to have a hidden hinge on a trunk or other top opening enclosure. This "dog leg" 126 may be used in lieu of an additional door stay to prop the door opened. Multiple dog legs 126 can be incorporated into the design, if desired, to accommodate holding the lid in more than one position.

Figure 23:
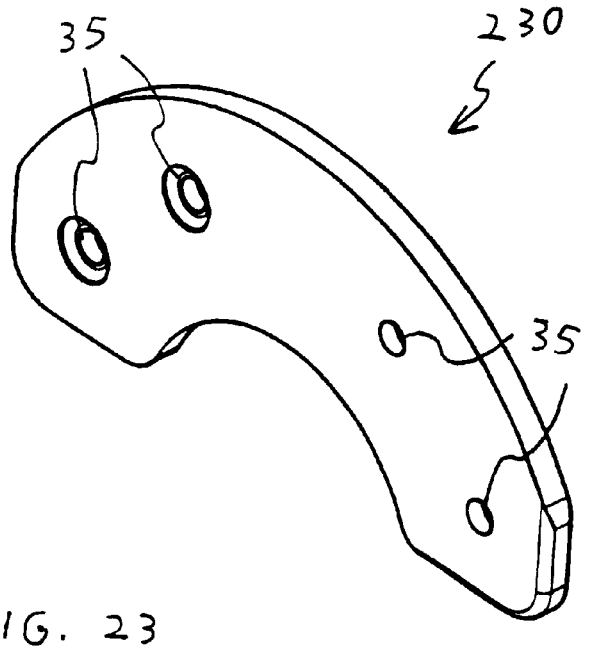
FIG. 23 is a perspective view of a third crescent member for a third embodiment of a crescent hinge according to the present invention.

Second, as can be seen in the third embodiment 210 of FIGS. 15–21, a similar hinge design is depicted that provides for a greater than 180 degree opening. Here, two first crescent members 20 are used in combination with a third crescent member 230 (FIG. 23). This third crescent member 230 includes holes 35 dimensioned and configured to receive a pair of rivets 40 at each end. This embodiment has twice the travel due to use of two arcuate cutouts 24. It is noted that both members 20 may be identical. Additionally, if the third crescent member 230 is designed to slide more freely in one of the two crescent members, for example, by greater friction created by rivets 40, the lid stay feature of the second embodiment may be utilized.

Figure 32:
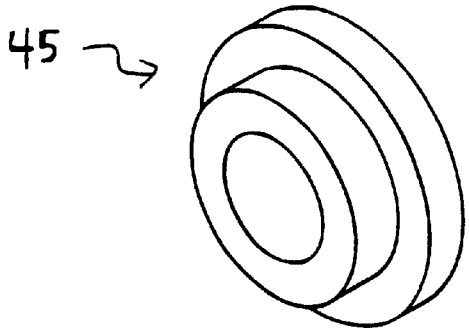
FIG. 32 is a perspective view of a bushing for a crescent hinge according to the present invention.

Optional for use in all of the above embodiments is use of bushing 45 as depicted in FIG. 32 in combination with a rivet 40. The use of the bushing 45 is pivotally secured between the rivet 40 and first crescent member 20, allowing for a rolling surface to provide for greater wear resistance and smoother and easier operation.

Figure 31:
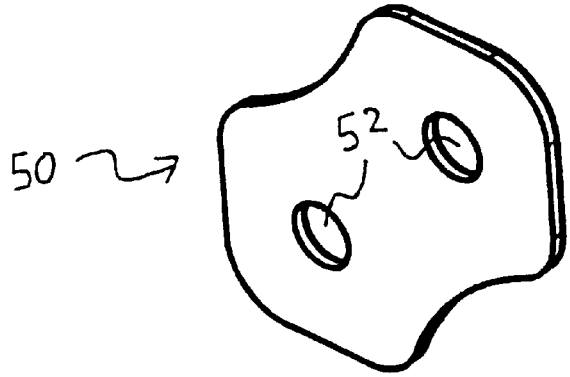
FIG. 31 is a perspective view of a washer for a crescent hinge according to the present invention.

Additionally, a washer 50 (FIG. 31) may be used between the crescent members 20,30 to reduce friction. The washer preferably defines a hole 52 corresponding to, and dimensioned and configured to receive, each rivet 40. The preferred embodiment will therefore include two holes 52. Preferred and suggested materials for the washer 50 are nylon and bronze, both of which will have a low coefficient of friction.

Finally, the arcuate cut out of the above embodiments can also have a somewhat more free form shape to allow the door to open following a prescribed free form arc to accommodate clearances or other required geometry during the rotation of the door to opened and closed positions.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

We claim:

1. A hinge visible from only one side of a door, for mounting a door to a frame, comprising:

(a) a first crescent member having mounting means for mounting to the door and an arcuate cutout, said arcuate cutout describing a radius about a point that is an actual hinge point of the door relative to the frame; and (b) a second crescent member having mounting means for mounting to the frame, and a pair of protruding members adapted to be received within said arcuate cutout, said protruding members adapted to secure said first crescent member to said second crescent member, whereby said first crescent member is movable about said actual hinge point with respect to said second crescent member.

2. The hinge according to claim 1, including a dog leg projection in said arcuate cutout for securing the door in an open position.

3. The hinge according to claim 1, including bushings surrounding said protruding members to provide a sliding action of said first crescent member with respect to said second crescent member.

4. The hinge according to claim 1, wherein said hinge further comprises a first mounting flange and a second mounting flange, said first mounting flange is attached to said first crescent member and said second mounting flange is attached to said second crescent member.

5. The hinge according to claim 4, wherein:

said first crescent member and said second crescent member each define an interior crescent surface; and said mounting flanges extend around said interior crescent surfaces.

6. The hinge according to claim 1, further comprising a washer between said first crescent member and said second crescent member, said washer defining a hole corresponding to each protruding member of said second crescent member, said washer having a low coefficient of friction.

7. A hinge visible from only one side of a door, for mounting a door to a frame, comprising:

(a) a first crescent member having mounting means for mounting to the door and an arcuate cutout, said arcuate cutout describing a radius about a point that is an actual hinge point of the door relative to the frame;

(b) a second crescent member, having two pairs of protruding members, said first pair of protruding members adapted to be received within said arcuate cutout of said first crescent member, said first pair of protruding members adapted to secure said first crescent member to said second crescent member; and (c) a third crescent member having mounting means for mounting to the frame and an arcuate cutout, said arcuate cutout describing a radius about a point that is an actual hinge point of the door relative to the frame, said second pair of protruding members of said second crescent member adapted to be received within said arcuate cutout of said third crescent member, said second pair of protruding members adapted to secure said second crescent member to said third crescent member, whereby said first and third crescent members are movable about said actual hinge point with respect to said second crescent member allowing the door to open at least 180 degrees with respect to the frame.

8. The hinge according to claim 7, including a dog leg projection in at least one of said arcuate cutouts for securing the door in an open position.

9. The hinge according to claim 7, including bushings surrounding said protruding members to provide a sliding action of said first crescent member with respect to said second crescent member.

10. The hinge according to claim 7, wherein said hinge further comprises a first mounting flange and a second mounting flange, said first mounting flange is attached to said first crescent member and said second mounting flange is attached to said third crescent member.

11. The hinge according to claim 10, wherein:

said first crescent member and said third crescent member each define an interior crescent surface; and said mounting flanges extend around said interior crescent surfaces.

12. The hinge according to claim 7, further comprising a washer between said first crescent member and said second crescent member, said washer defining a hole corresponding to each protruding member of said second crescent member, said washer having a low coefficient of friction.

* * * * *